US006187109B1

(12) United States Patent
Park et al.

(10) Patent No.: US 6,187,109 B1
(45) Date of Patent: Feb. 13, 2001

(54) CLEANING COMPOSITION FOR REMOVING FOULING AND A METHOD FOR USING THE SAME

(75) Inventors: Sam-Ryong Park, Ulsan; Young-Kyoung Ahn, Koyang; Sung-Gu Oh; Gi-Won Park, both of Ulsan, all of (KR)

(73) Assignee: SK Corporation, Seoul (KR)

( * ) Notice: Under 35 U.S.C. 154(b), the term of this patent shall be extended for 0 days.

(21) Appl. No.: 09/610,711

(22) Filed: Jul. 6, 2000

(30) Foreign Application Priority Data

Mar. 20, 2000 (KR) ..... 00-14075

(51) Int. Cl.[7] ..... B08B 3/04; C11D 7/22; C11D 7/50

(52) U.S. Cl. ..... 134/40; 510/185; 510/188; 510/195; 134/39

(58) Field of Search ..... 510/185, 188, 510/195; 134/39, 40

(56) References Cited

U.S. PATENT DOCUMENTS

| | | | | |
|---|---|---|---|---|
| 3,667,510 | | 6/1972 | Sattler | 140/92.2 |
| 4,773,357 | | 9/1988 | Scharton et al. | 122/382 |
| 4,925,497 | * | 5/1990 | Thierheimer, Jr. | 134/40 |
| 5,006,304 | | 4/1991 | Franklin et al. | 376/316 |
| 5,085,710 | | 2/1992 | Goss | 134/22.14 |
| 5,601,657 | | 2/1997 | Baum | 134/3 |
| 5,841,826 | * | 11/1998 | Rootham et al. | 376/316 |
| 5,998,352 | * | 12/1999 | Vlasblom | 510/365 |

FOREIGN PATENT DOCUMENTS

| | | |
|---|---|---|
| 6-126262 | 5/1994 | (JP) . |
| 10-316997 | 12/1998 | (JP) . |

* cited by examiner

*Primary Examiner*—Gregory R. Delcotto
(74) *Attorney, Agent, or Firm*—Seidel Coonda Lavorgna & Monarco, PC

(57) ABSTRACT

Disclosed is a cleaning composition useful for dislodging fouling from process lines of oil refining or petrochemical plants and a cleaning method using the composition. The cleaning composition comprises 0.01 to 1 wt % of a C8 aromatic compound, 75 to 85 wt % of a C9 aromatic compound and 14 to 24 wt % of a C10 aromatic compound. When applied to the process lines, the composition is mixed at an amount of 2 to 20 vol % with Light cycle oil or light gas oil. Chemical cleaning with the composition effectively removes the fouling formed within the process lines and heat exchangers of oil refining or petrochemical plants, and recovers the processing capacity of heat exchangers to the start of run level, bringing about a significant economic profit.

7 Claims, No Drawings

CLEANING COMPOSITION FOR REMOVING FOULING AND A METHOD FOR USING THE SAME

BACKGROUND OF THE INVENTION

1. Field of the Invention

The present invention relates to the removal of fouling from the process lines of oil refining or petrochemical plants. More particularly, the present invention relates to a cleaning composition, which has excellent solvent strength against the fouling formed within oil refining or petrochemical process lines. Also, the present invention is concerned with a method for dislodging fouling using such a cleaning composition.

2. Description of the Prior Art

In oil-refining plants or petrochemical plants, fouling is one of the most problematic obstacles to their effective operation because it reduces the efficiency of heat exchangers and causes a large loss of energy as well as requiring frequent periodic maintenance for its removal. Typically, fouling results from deposits of crude petroleum, such as sand, silt and clay, corrosion of FeS, and heavy hydrocarbons, such as asphaltene.

In order to remove such fouling, various cleaning methods have been developed, along with cleaning agents. U.S. Pat. Nos. 4,773,357 and 5,006,304 disclose mechanical cleaning methods, in which a high velocity jet of water is applied to heat exchangers which are opened after the operation of the oil refining plant is ceased. In addition to costing a great deal of money in the cleaning of heat exchangers, such methods force the plant to submit to a serious loss because of the operation halt of the heat exchangers. Further, the opening of heat exchangers releases volatile organic compounds (VOC), producing pollution of the environment.

Chemical cleaning methods are referred to in U.S. Pat. Nos. 5,601,657 and 3,667,487. In general, chemical cleaning methods are based on the use of antifoulants. However, their poor cleaning efficiency per cost prevents applying the chemicals to entire oil refining processes.

U.S. Pat. No. 5,085,710 teaches the use of LCO (light cycle oil) having economical advantages over non-ionic surfactants or chemical cleaning agents in oil storage tanks so as to minimize the generation of sludge and to separate and recover hydrocarbons. The use of LCO as a cleaning agent is also referred to in Japanese Pat. Laid-Open No. Heisei 10-316997, in which 3-ethoxy propylene acid ethyl is used to remove a sludge and pollutants in heat exchangers without the problems of corrosion and waste water. Also Japanese Pat. Laid-open No. Heisei 6-126262 discloses that LCO is preheated to increase its solvent strength, and is used for the cleaning of heat exchangers.

For the cleaning of oil refining or petrochemical process lines, light gas oil (LGO) has recently been utilized. LGO is usually produced in a crude distillation unit (CDU). LGO is used as diesel or as a blending material for bunker C oil or kerosene. Since sufficient LGO is produced in CDU at low cost, and which can be readily utilized, LGO has been used with chemicals of 1 to 3 wt % added in the cleaning of process lines.

LGO and LCO are, however, a little bit inferior to expensive solvents such as toluene in solvent power, so they need the aid of other chemicals in cleaning process lines. However, the problems resulting from a poor solvent strength are not resolved in this method. Accordingly, there have been needs for more economical cleaning agents with good solvent strength.

SUMMARY OF THE INVENTION

Leading to the present invention, the extensive and thorough research on the removal of fouling, repeated by the present inventors aiming to overcome the conventional problems resulting from economical unfavorableness and insufficient cleaning efficiency, resulted in the finding that a non-aqueous cleaning composition comprising C8, C9 and C10 aromatic compounds, optionally in combination with LGO or LCO, is useful to effectively remove the fouling formed in the process lines of oil refining and petrochemical plants.

Therefore, it is an object of the present invention to overcome conventional problems encountered in the prior art and to provide a cleaning composition which can effectively remove fouling to recover, to the start of run (SOR) level, the heat exchanger efficiency otherwise lost by fouling.

It is another object of the present invention to provide a method for removing fouling from process lines of oil refining and petrochemical plants.

Based on the present invention, the above object can be accomplished by providing a cleaning composition, comprising 0.01 to 1 wt % of a C8 aromatic compound, 75 to 85 wt % of a C9 aromatic compound and 14 to 24 wt % of a C10 aromatic compound.

In the method of invention, the cleaning composition is mixed at an amount of 2 to 20 vol % with LCO or LGO.

DETAILED DESCRIPTION OF THE INVENTION

Typically, the fouling formed within process lines or heat exchangers in oil refining or petrochemical plants is composed of organic materials and inorganic materials. The cleaning composition of the present invention is intercalated between inorganic materials and organic materials in the fouling, so as to melt the organic materials and disintegrate the fouling. Hydrocarbons are arranged in the following manner by solvent strength:

iso-paraffin<n-paraffin<naphthene<aromatic compounds

Accordingly, appropriate combination of aromatic compounds results in a composition with a potent solvent strength. In the present invention, a cleaning composition comprises C8, C9 and C10 aromatic compounds.

A C8 aromatic compound useful in the present invention is o-xylene. A preferable amount of this compound falls in the range of 0.01 to 1 wt %. The C9 aromatic compound is preferably selected from the group consisting of 1,2,4-trimethyl benzene, 1-methyl-3-ethyl benzene, and mixtures thereof. The C9 aromatic compound is preferably used at an amount of 75 to 85 wt %. The C10 compound is preferably selected from the group consisting of 1-methyl-3-n-propylbenzene, 1,2-dimethyl-4-ethylbenzene, 1,2,3,5-tetramethylbenzene, and mixtures thereof and preferably used at an amount of 14 to 24 wt %. When any of the aromatic compounds are used at amounts of less than their respective lower limits, the resulting cleaning effect is insufficient. This is also true of amounts exceeding the upper limit, because the other aromatic compounds must then be used at amounts lower than their respective lower limits.

Optionally, the cleaning composition may be used in combination with LCO or LGO in accordance with the present invention. As well known, LCO, which is usually produced as an intermediate distillate in the fluid catalytic cracking process, is used as a blending material for bunker-C oil or diesel. LGO, which is produced in a crude distillation unit (CDU), is used as a diesel or as a blending material for bunker-C oil or kerosene. A particular combination of the cleaning composition and LCO or LGO is similar in solvent power to pure toluene, which has an excellent solvent power. In this regard, the cleaning composition is preferably used at an amount of 2 to 20 vol %. For example, if the amount of the cleaning composition is below 2 vol %, only a poor cleaning effect is obtained. On the other hand, greater than 20 vol % of the cleaning composition reduces the synergy effect of LCO or LGO. In detail, the cleaning composition of the present invention is preferably mixed at an amount of 2 to 10 vol % with LCO and 5 to 20 vol % with LGO to maintain cleaning efficiency.

A better understanding of the present invention may be obtained in light of the following examples which are set forth to illustrate, but are not to be construed to limit, the present invention.

EXAMPLES 1 TO 3

Properties and component amounts of the cleaning composition according to the present invention are given in Table 1, below. In these Examples, o-xylene was selected as the C8 aromatic compound, a mixture of 1,2,4-trimethylbenzene and 1-methyl-3-ethylbenzene as the C9 aromatic compound, and 1-methyl-3-n-propylbenzene as the C10 aromatic compound.

TABLE 1

| | Composition Properties | | |
|---|---|---|---|
| API | 28.8 | Distillation (° C.) | |
| C8 Aromatic Cpd. | 0.05 wt % | Initial Distilling Point | 163.0 |
| C9 Aromatic Cpd. | 80.78 wt % | 10% | 164.4 |
| C10 Aromatic Cpd. | 19.17 wt % | 20% | 164.9 |
| | | 50% | 166.2 |
| | | 90% | 176.7 |
| | | 95% | 199.0 |
| | | Final Distilling Point | 220.8 |

In Table 1, the initial distilling point, which represents the initial boiling point of the oil, means the temperature of the gas phase when a condensate is formed initially in a rear condenser while 100 $cm^3$ of oil is distilled at a constant rate of 5 cc per min. The final distilling point means the final boiling point of the oil.

In Examples 2 and 3, LCO and LGO were used along with 10 vol % and 20 vol % of the cleaning composition (A) according to the present invention, respectively. The resulting cleaning compositions were measured for solvent strength and the results are given in Table 2, below.

The solvent strength was calculated as a ratio of the residual amount (W') of a residual crude (RC) to an initial amount (Wo) of the RC, the residual amount (W') being obtained after the RC of 1 g was dissolved in the cleaning composition and filtered through a filter with a pore size of 0.45 $\mu$m.

TABLE 2

| Solvent | Solvent Strength (W'/Wo) |
|---|---|
| Toluene | 0.56 |
| LCO | 3.15 |
| LGO | 6.75 |
| Example 1 (Composition A) | 0.44 |
| Example 2 (LCO + A 10%) | 0.50 |
| Example 3 (LGO + A 20%) | 0.58 |

As indicated in Table 2, LCO and LGO themselves are poor in solvent strength compared with toluene, but they show similar solvent strength when being combined with the cleaning composition (A) of the present invention.

As described hereinbefore, the cleaning composition of the present invention can have a similar solvent strength to that of expensive toluene even when being mixed in a small amount with LCO or LGO. Therefore, use of the cleaning composition, is economically favorable. In addition, chemical cleaning with the composition of the present invention effectively removes the fouling formed within the process lines and heat exchangers of oil refining or petrochemical plants, and recovers the processing capacity of heat exchangers to the SOR level, bringing about a significant economic profit.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A cleaning composition for dislodging fouling from process lines of oil refining and petrochemical plants, comprising 0.01 to 1 wt % of a C8 aromatic compound, 75 to 85 wt % of a C9 aromatic compound and 14 to 24 wt % of a C10 aromatic compound.

2. The cleaning composition as set forth in claim 1, wherein the C8 aromatic compound is o-xylene.

3. The cleaning composition as set forth in claim 1, wherein the C9 aromatic compound is selected from the group consisting of 1,2,4-trimethylbenzene, 1-methyl-3-ethylbenzene, and mixtures thereof.

4. The cleaning composition as set forth in claim 1, wherein the C10 aromatic compound is selected from the group consisting of 1-methyl-3-n-propylbenzene, 1,2-dimethyl-4-ethylbenzene, 1,2,3,5-tetramethylbenzene, and mixtures thereof.

5. A method for dislodging fouling from process lines of oil refining or petrochemical plants, comprising mixing the cleaning composition of claim 1 at an amount of 2 to 20 vol % with light cycle oil or light gas oil and circulating the mixture through said process lines.

6. The method as set forth in claim 5, wherein the cleaning composition is mixed at an amount of 2 to 10 vol % with light cycle oil.

7. The method as set forth in claim 5, wherein the cleaning composition is mixed at an amount of 5 to 20 vol % with light gas oil.

* * * * *